United States Patent [19]

Kuhnemann

[11] 4,085,903

[45] Apr. 25, 1978

[54] YARN WINDING APPARATUS

[75] Inventor: Klaus Dieter Kuhnemann, Kingston, Canada

[73] Assignee: Du Pont of Canada Ltd., Montreal, Canada

[21] Appl. No.: 721,767

[22] Filed: Sep. 9, 1976

[30] Foreign Application Priority Data

Nov. 12, 1975 Canada ..... 239616

[51] Int. Cl.[2] ..... B65H 57/28

[52] U.S. Cl. ..... 242/43.1; 242/158 R

[58] Field of Search ..... 242/43, 43.1, 158, 158.5

[56] References Cited

U.S. PATENT DOCUMENTS

| | | | |
|---|---|---|---|
| 3,730,448 | 5/1973 | Schippers et al. | 242/43.1 |
| 3,904,140 | 9/1975 | Hermanns | 242/43.1 |

*Primary Examiner*—Leonard D. Christian

[57] ABSTRACT

A vertically mounted high speed winding device for parallel plied textured yarns which device has a vertical friction roller driven at a constant high speed and adapted to rotate a package by surface contact. The device also includes a traversing mechanism embodying an L-shaped lever rotatably attached at its apex to a layrail which is adapted to reciprocate longitudinally of the package at a constant stroke length. One arm of the L-shaped lever carries a traverse modulating yarn guide, e.g., an eccentrically mounted rotatable disc. The other arm of the L-shaped lever is pivotably connected to a slide block slidable in a U-track which is pivotable about a horizontal axis. A cam means is provided for changing the angular position of the U-track with increasing package diameter for the production of conical ended packages. The winding device is useful for the high speed winding of parallel plied textured yarn in packages from which the yarn may be fed directly to knitting machines and in which the yarn wound thereon exhibits high bundle cohesion.

2 Claims, 4 Drawing Figures

YARN WINDING APPARATUS

BACKGROUND OF THE INVENTION

This invention relates to a high speed winding device for textured yarns and, more particularly, to a vertically mounted high speed winding device for parallel plied textured yarns.

As used herein the term "high winding speed" means a yarn speed in the range of from at least 400 meters per minute to about 1000 meters per minute. The term "parallel plied textured yarn" means two false twist textured yarn strands, one having "S" twist and the other "Z" twist, for example as produced by a double ended draw texturing process and laid in parallel onto a package. The term "helix angle" means the acute angle between the helix or convolution of the yarn and a diametrical plane intersecting the convolution.

Several winding devices known in the art utilize a relatively low speed, full traverse stroke initially, the stroke length being gradually reduced as the yarn package builds in order to produce a package with conical ends. When such a winding device is used for high speed winding of parallel plied textured yarn, the yarn is laid down on the package at a low helix angle because of the high yarn speed to traverse speed ratio. Moreover, parallel plied textured yarn wound on a package on such a winding device exhibits an apparent lack of bundle cohesion. As a consequence of the low helix angle and lack of bundle cohesion, the parallel plied textured yarn on removal from the package over the end thereof tends to snag, to split into its two components and to spiral around the package as it is dragged over the package surface. The above yarn take-off characteristics and the high take-off tension resulting therefrom make packages of parallel plied textured yarn wound on such a winding device unsuitable for being fed directly to a knitting machine. In the past a separate ply-twisting step has often been added to overcome this take-off problem with parallel plied textured yarn.

High speed winding devices which utilize a full stroke traverse, wind yarn at a high helix angle and produce stable, low tension cylindrical or bi-conical packages have recently become available. However, these winding devices are complex and expensive and may require "fanning guide distance" to "stroke length" ratios as high as 5:1; the "fanning guide distance" being the distance from the traverse guide to the last guide the yarn touches prior to the traverse guide. Such high "fanning guide distance" to "stroke length" ratios, which greatly increase the building space required to house the winding devices, are required because of the very high traverse speeds required to achieve the reasonably uniform tension and the high helix angle required for acceptable package formation at high winding speeds.

U.S. Pat. No. 3,730,448 which issued May 1, 1973 to H. Schippers et al. discusses a horizontally mounted relatively low speed, winding device which utilizes a full traverse stroke initially, the stroke length being gradually reduced as the package builds in order to produce a package with conical ends. A modification allowing rapid changes in package taper angles and means of superimposing intermittent stroke reduction in order to avoid so-called hard edges at the yarn reversal points are also discussed in U.S. Pat. No. 3,730,448.

French Pat. No. 1,579,444, publication date Aug. 22, 1969, discloses a horizontally mounted winding device for wire in which stroke modulation is achieved by mounting a V-grooved pulley on a full stroke traversing guide to guide the wire onto a spool. The pulley is mounted in a skew position on its axis, i.e., not perpendicular thereto, and the axis of the pulley is parallel to the axis of the spool. Thus, as the pulley rotates a sinusoidal pattern of low amplitude and relatively high frequency is superimposed on the laydown pattern of the low speed full stroke traversing guide.

A V-grooved pulley guide similar to that disclosed in French Pat. No. 1,579,444 may be combined with a winding device of the type discussed in aforementioned U.S. Pat. No. 3,730,448 to produce a horizontally mounted winding device that is useful for winding many types of yarns at very high winding speeds. However, this combination does not provide a vertically mounted winding device for winding yarn at high speeds. Neither does it provide a winding device which will "exercise the yarn" being wound on package as appears to be required to achieve good bundle cohesion in parallel plied textured yarn being wound at high winding speeds. As used herein, the term "exercise the yarn" means to impart a vibratory motion to parallel plied textured yarn immediately before it is wound on a package, such that the "S" twist and the "Z" twist yarn strands are intermingled to give bundle cohesion to the yarn. As the distance travelled by the yarn would remain constant as the V-grooved pulley rotates, no vibratory motion would be imparted to the yarn by the pulley. As used herein the term "vibratory motion" means repetitive changes in the distance travelled by the yarn which occur at a high frequency and result in a high frequency variation in the tension of the yarn.

It is an object of this invention to provide a vertically mounted high speed winding device for winding parallel plied textured yarn on a biconical package, in which the yarn is laid down with a substantial angle between successive yarn wraps on the package and in which a vibratory motion is imparted to the yarn immediately before it is laid down on the package.

SUMMARY OF THE INVENTION

With this and other objects in view the present invention provides a vertically mounted high speed winding device for parallel plied textured yarn comprising

- a vertical friction roller driven at a constant high speed and adapted to rotate a package by surface contact;
- a traversing mechanism embodying an L-shaped lever rotatably attached at its apex to a layrail, the layrail being adapted to reciprocate longitudinally of the package at a constant stroke length;
- one arm of the L-shaped lever carrying a traverse modulating yarn guide;
- the other arm of the L-shaped lever being pivotably connected to a slide block slidable in a U-track, the U-track being pivotable about a horizontal axis;
- cam means for changing the angular position of the U-track with increasing package diameter for the producting of conical ended packages;
- the traverse modulating yarn guide being adapted to impart a vibratory motion and a sinusoidal pattern to the yarn being wound on the package.

In one embodiment of the present invention the cam means for changing the angular position of the U-track with increasing package diameter is attached to one of two chuck arms which carry the package and the cam transmits the movement of the chuck arm to the U-track through a cam follower and a lever arm.

In another embodiment of the present invention the cam means for changing the angular position of the U-track with increasing package diameter, is driven by a stepping motor and the cam acts on a pin positioned on the U-track to change the angular position thereof.

In yet another embodiment of the present invention the traverse modulating yarn guide is an eccentrically mounted rotatable disc which is rotated by the travelling yarn.

DETAILED DESCRIPTION OF THE ILLUSTRATED EMBODIMENTS

Figure 1:
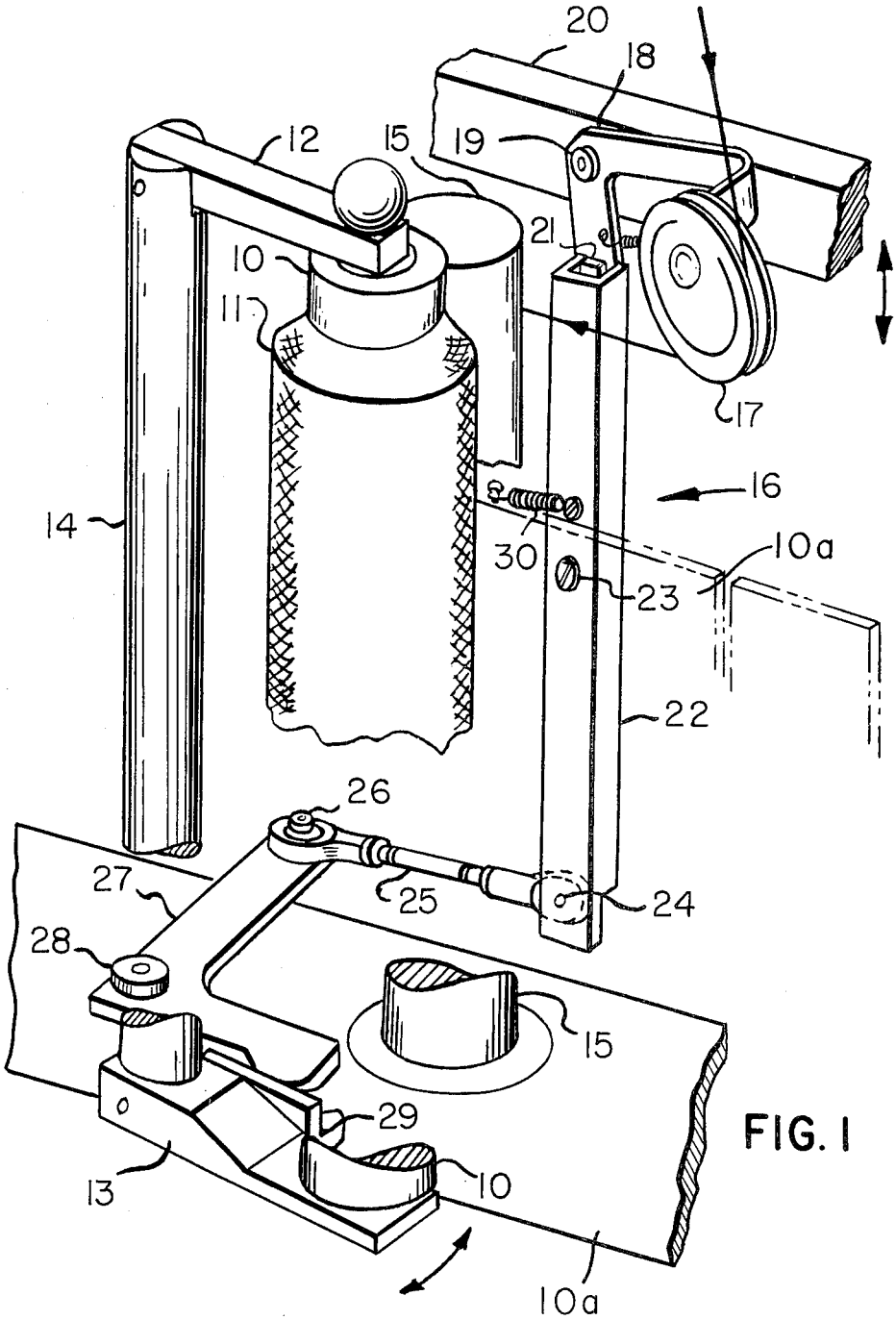
FIG. 1 is a schematic view of one embodiment of the present invention (with parts removed for clarity) in which the effective stroke length is reduced as the package diameter increases by means of mechanical linkages which sense the package build up.

In the drawings, FIG. 1 shows a yarn tube 10 on which a package 11 is built during winding. The yarn tube 10 is carried by spring loaded chuck arms 12 and 13 which are mounted on shaft 14. Shaft 14 is free to rotate such that chuck arms 12 and 13 can be deflected about its axis as the package diameter increases.

The package 11 is driven at a high constant speed by a friction roller 15 against which it is held by chuck arms 12 and 13. The friction roller 15 is driven by a belt (not shown).

A traversing mechanism 16 is provided to guide the yarn to be wound, onto the surface of friction roll 15 which in turn deposits it on package 11. Traversing mechanism 16 (see also FIGS. 2 and 3) comprises a traverse modulating yarn guide, depicted in this embodiment as an essecntrically mounted rotatable disc 17 arranged on one end of an L-shaped lever 18 by which it is reciprocated longitudinally of the yarn tube 10. The L-shaped lever 18 is rotatably attached by a pin 19 to a layrail 20 which extends over the entire length of the machine and is common to all the L-shaped levers on one side of the machine. Layrail 20 is driven with respect to machine frame 10*a* to reciprocate longitudinally of the yarn tube 10 at a constant stroke length.

Arranged on the other end of L-shaped lever 18 there is a slide block 21 which is guided in U-track 22 in such a way that, during reciprocation of layrail 20, it can slide to and fro in it. U-track 22 is pivotable about pin 23. The bottom end of U-track 22 is attached by pin 24 to lever arm 25. The other end of lever arm 25 is connected by pin 26 to one end of an L-shaped cam follower 27. A vertical pin 28 in the apex of L-shaped cam follower 27 allows the cam follower 27 to rotate in a horizontal plane. The other end of cam follower 27 rests against a cam 29 which is attached to chuck arm 13.

The upper end of U-track 22 is engaged by a spring 30 anchored in the machine frame 10*a*. Spring 30 attempts to rotate U-track 22 about pin 23, which in turn pulls on lever arm 25 and keeps the cam follower 27 firmly pressed against cam 29.

In operation, yarn preferably parallel plied textured yarn, for example, such yarn obtained directly from a double ended draw texturing process, travels part way round eccentrically mounted rotatable disc 17, part way around friction roll 15 and is wound up on yarn tube 10 as a package 11. Chuck arms 12 and 13 hold package 11 against friction roller 15 which is rotatably driven at constant speed.

At the beginning of package formation, yarn tube 10 touches friction roller 15. As the yarn tube 10 is moved into this position, chuck arm 13, acting through cam 29, cam follower 27 and lever arm 25, pivots U-track 22, about pin 23, against the pull of string 30, into the position shown in FIG. 2. With U-track 22 in this position, the reciprocation of layrail 20 at constant stroke length causes slide block 21 arranged at one end of L-shaped lever 18 to slide to and fro in U-track 22. As this motion occurs, L-shaped lever 18 rotates on pin 19 such that the traverse modulating yarn guide, i.e., eccentrically mounted freely rotatable disc 17, arranged at the other end of L-shaped lever 18, performs a yarn winding stroke of maximum length.

The rotation of freely rotatable disc 17 about its eccentric axis causes the yarn to be laid down on package 11 in a sinusoidal pattern thus providing a substantial angle between successive yarn wraps on the package 11. Moreover, the variation in the distance travelled by the yarn as it passes around rotatable disc 17 causes a high frequency variation in tension, i.e., a vibratory motion to be imparted to the yarn as it passes between the rotatable disc 17 and friction roller 15. This vibratory motion tends to "exercise" parallel plied textured yarn at low tension such that the "S" twist and "Z" twist strands of yarn are intermingled to give bundle cohesion to the yarn.

Although in this embodiment an eccentrically mounted rotatable disc 17 has been shown as the traverse modulating yarn guide, it will be appreciated by those skilled in the art that other devices which produce such vibratory motion may also be employed. Two such other devices are: (1) an electric resonance oscillator and (2) a pneumatic flip-flop device.

As the diameter of package 11 increases, chuck arm 13 moves in a clockwise direction and attempts to move cam 29 away from cam follower 27. This allows spring 30 to pivot U-track 22 about pin 23, gradually, until at the completion of package formation, U-track 22 is in the position shown in FIG. 3. With U-track 22 in this position, in a similar manner as hereinbefore described, eccentrically mounted rotable disc 17 performs a yarn winding stroke of minimum length. Thus a conical ended package is produced having a length next to the yarn tube equivalent to the maximum yarn winding stroke and a length at its outer surface equivalent to the minimum yarn winding stroke of eccentrically mounted rotatable disc 17.

Figure 2:
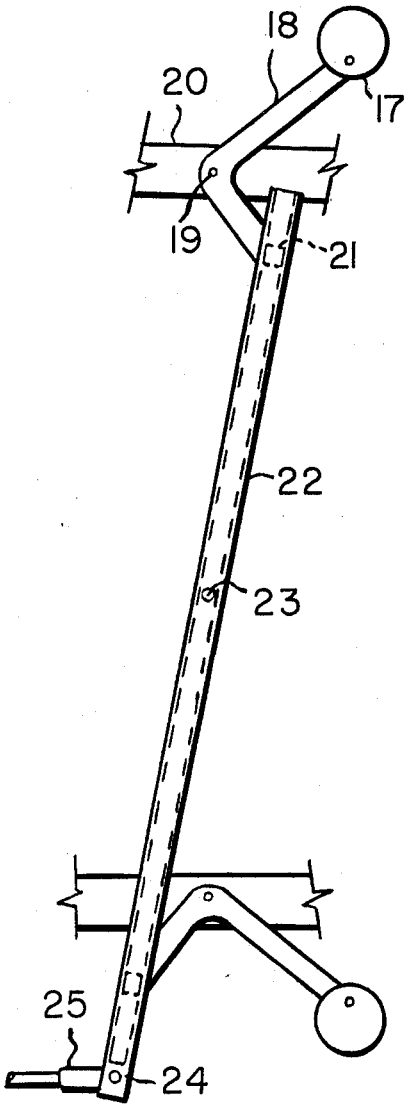
FIG. 2 is a fragmentary view of the embodiment of FIG. 1 showing the U-track in position for maximum stroke with the layrail and the traverse modulating yarn guide depicted (for ease of understanding) in both their highest and their lowest positions.
Figure 3:
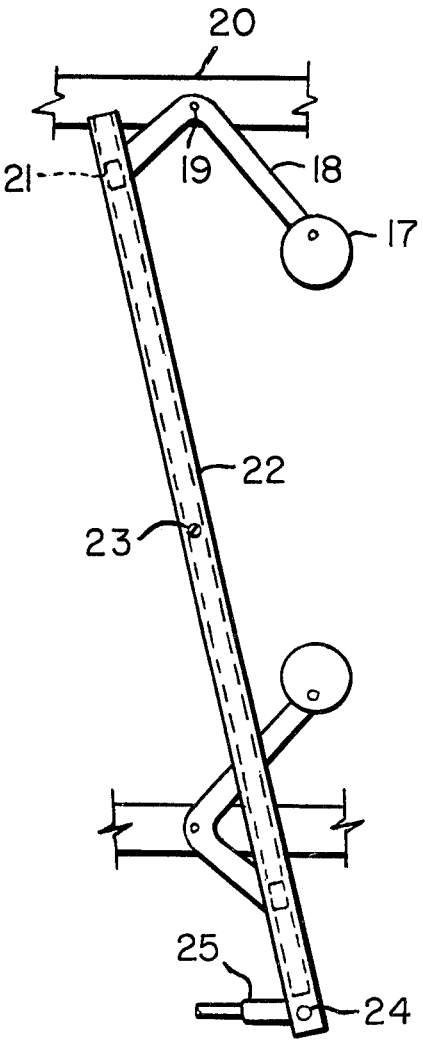
FIG. 3 is a fragmentary view of the embodiment of FIG. 1 showing the U-track in position for minimum stroke with the layrail and the traverse modulating yarn guide again depicted (for ease of understanding) in both their highest and their lowest positions.
Figure 4:
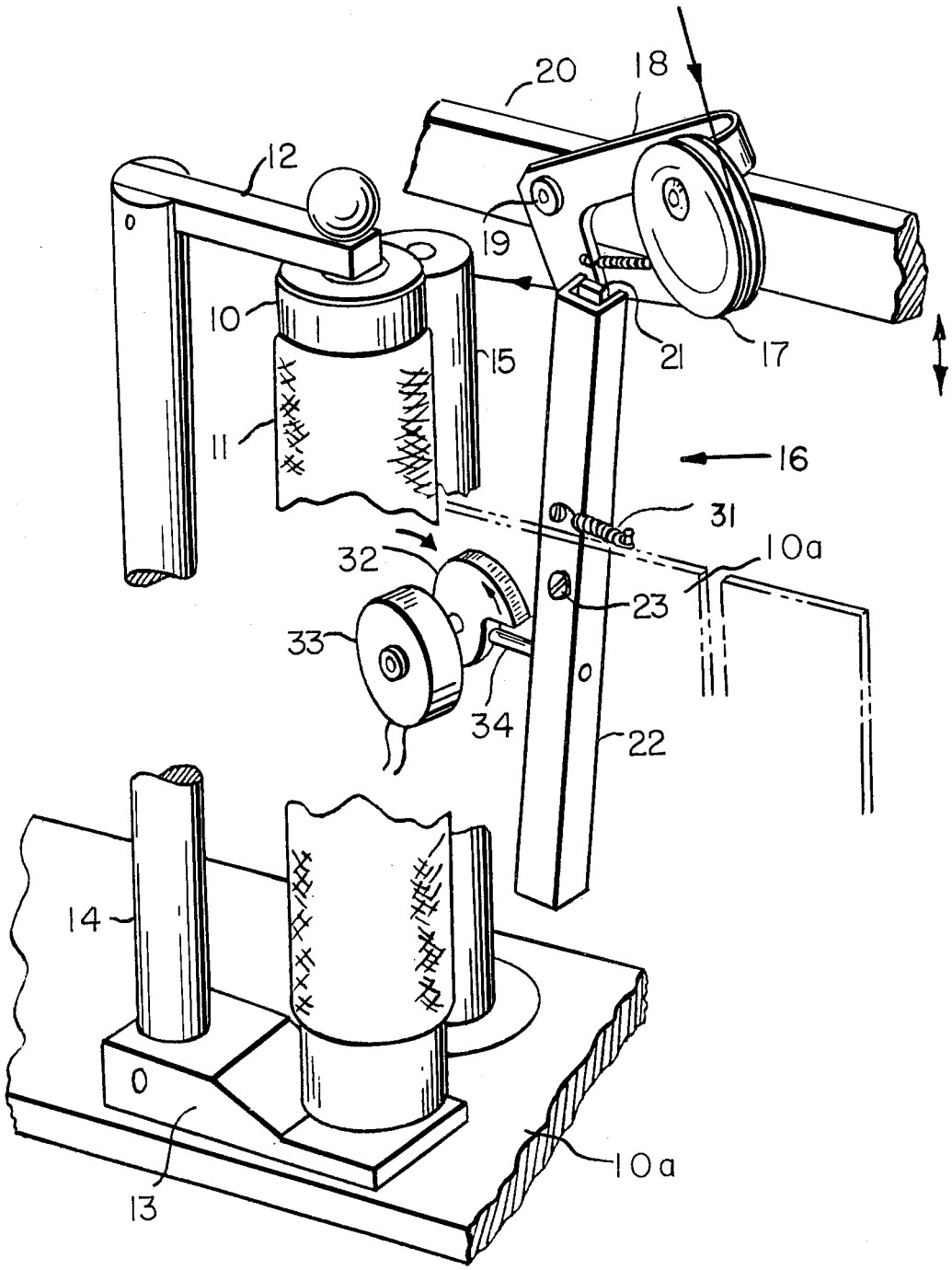
FIG. 4 is a schematic view of another embodiment of the present invention (with parts removed for clarity) in which the effective stroke length is reduced over a period of time by means of a cam driven by a stepping motor.

FIG. 4 shows a variation in the apparatus of FIG. 1, wherein a cam 32 powered by a stepping motor 33, acts on a pin 34, positioned on U-track 22, to pivot U-track 22 about pin 23, against the pull of spring 31, from the position shown in FIG. 2 at the start of package formation to the position shown in FIG. 3 at the completion of package formation. Stepping motor 33 is arranged such that cam 32 turns less than one revolution during the winding of a complete package. The contour of cam 32 is designed to give the desired end taper to the package. It will be appreciated that cam 32 may be readily exchanged for other cams having different contours such that packages having different shapes and end tapers may be produced.

Parallel plied textured yarn wound in a package at a high speed on the winding device of the present invention exhibits high bundle cohesion and thus may be fed satisfactorily directly from the package to a knitting machine. The good take-off characteristics of parallel plied textured yarn from packages produced on the winding device of the present invention has made superfluous the separate ply twisting operation often used heretofor in the winding of such yarn.

What is claimed is:

1. A yarn winding apparatus comprising:

a frame;

a driven friction roller rotatably mounted to said frame in a vertical position;

a rotatable package in surface contact with said roller;

a layrail horizontally positioned in close proximity to said friction roller; means for reciprocating the layrail longitudinally of the package;

a modulating yarn guide means for imparting vibratory motion to the yarn; and means connected between said modulating yarn guide and said layrail for traversing said modulating yarn guide means the length of said package; so that the modulating yarn guide imparts a vibratory motion to the yarn throughout the length of the package immediately before it is laid down on a package.

2. A yarn winding apparatus comprising:

a frame;

a driven friction roller rotatably mounted to said frame in a vertical position;

a rotatable package in surface contact with said roller;

a layrail horizontally positioned in close proximity to said friction roller; means for reciprocating the layrail longitudinally of the package;

an L-shaped arm rotatably mounted to the layrail at the apex of the arm;

a rotatable disc having a peripheral groove eccentrically mounted to one end of said arm; and guide means extending substantially the length of said package, the other end of said L-shaped arm being slideably connected to said guide means, said disc being rotated by yarn travelling around the perhipheral groove of the disc to said package.

* * * * *